US009335673B2

(12) United States Patent
Sato

(10) Patent No.: US 9,335,673 B2
(45) Date of Patent: May 10, 2016

(54) IMAGE FORMING APPARATUS AND METHOD OF CONTROLLING IMAGE FORMING APPARATUS FOR SEPARATING A RECORDING SHEET FROM AN IMAGE BEARING MEMBER

(71) Applicant: Konica Minolta Inc., Tokyo (JP)

(72) Inventor: Yotaro Sato, Tokyo (JP)

(73) Assignee: KONICA MINOLTA, INC. (JP)

( * ) Notice: Subject to any disclaimer, the term of this patent is extended or adjusted under 35 U.S.C. 154(b) by 0 days.

(21) Appl. No.: 14/220,502

(22) Filed: Mar. 20, 2014

(65) Prior Publication Data

US 2014/0286662 A1 Sep. 25, 2014

(30) Foreign Application Priority Data

Mar. 21, 2013 (JP) ..... 2013-058046

(51) Int. Cl.
*G03G 15/16* (2006.01)

(52) U.S. Cl.
CPC ..... *G03G 15/1645* (2013.01)

(58) Field of Classification Search
USPC ..... 399/38, 42, 46, 48, 66
See application file for complete search history.

(56) References Cited

U.S. PATENT DOCUMENTS 4,536,082 A * 8/1985 Motohashi et al. ..... 399/51
5,410,393 A * 4/1995 Watanabe ..... 399/313
5,956,548 A * 9/1999 Hattori ..... 399/168
6,345,168 B1 * 2/2002 Pitts ..... 399/314
8,185,007 B2 5/2012 Tsukamura et al.
2003/0035658 A1 2/2003 Ishii
2012/0106993 A1 * 5/2012 Michishita ..... 399/44
2012/0251139 A1 * 10/2012 Handa ..... G03G 15/0266 399/44
2013/0259502 A1 * 10/2013 Motomura ..... G03G 15/1645 399/50
2013/0259506 A1 * 10/2013 Katagiri ..... G03G 15/1675 399/66

FOREIGN PATENT DOCUMENTS

JP 08171260 A 7/1996
JP 10282814 A 10/1998

(Continued)

OTHER PUBLICATIONS

Japanese Notice of Reasons for Rejection corresponding to Patent Application No. 2013-058046; Dispatch Date: Feb. 24, 2015, with English translation.

(Continued)

*Primary Examiner* — Hoan Tran
(74) *Attorney, Agent, or Firm* — Cantor Colburn LLP

(57) ABSTRACT

An image forming apparatus includes: a rotatable image bearing member; a transferring member that forms a transfer nip portion with the image bearing member; a voltage application section that applies a voltage to the transferring member in such a manner that a certain amount of current flows through the transferring member; and a control section that sets a front-end current to a current that flows through the transferring member when a voltage having a polarity opposite to a transfer polarity and an absolute value substantially the same as or greater than an absolute value of a surface potential of the image bearing member is applied to the transferring member, the control section controlling the voltage application section in such a manner that the set front-end current flows through the transferring member when a front-end portion of a recording sheet in a conveyance direction passes through the transfer nip portion.

16 Claims, 8 Drawing Sheets

(56) References Cited

FOREIGN PATENT DOCUMENTS

| | | | |
|---|---|---|---|
| JP | 2000242091 | A | 9/2000 |
| JP | 2003057966 | A | 2/2003 |
| JP | 2004279490 | A | 10/2004 |
| JP | 2009042541 | A | 2/2009 |
| JP | 2010039468 | A | 2/2010 |
| JP | 2010181476 | A | 8/2010 |

OTHER PUBLICATIONS

Japanese Notice of Reasons for Rejection corresponding to Application No. 2013-058046; Date of Mailing: Sep. 29, 2015, with English translation.

* cited by examiner

| | CONDITION [°C/%] | LEAVING TIME [h] | USE HISTORY OF BELT | FRONT-END CURRENT [μA] | FRONT-END VOLTAGE [V] | SURFACE POTENTIAL [V] | FRONT-END VOLTAGE / SURFACE POTENTIAL | SEPARATION PERFORMANCE |
|---|---|---|---|---|---|---|---|---|
| EXAMPLE 1 | 30/80 | 20 | TWO MILLION SHEETS | −30 | −650 | −600 | 1.08 | GOOD |
| COMPARATIVE EXAMPLE 1A | 30/80 | 20 | TWO MILLION SHEETS | −10 | −250 | −600 | 0.42 | NOT GOOD |
| COMPARATIVE EXAMPLE 1B | 30/80 | 20 | TWO MILLION SHEETS | −20 | −470 | −600 | 0.78 | NOT GOOD |
| EXAMPLE 2 | 30/80 | 7 | TWO MILLION SHEETS | −15 | −540 | −600 | 0.90 | GOOD |
| COMPARATIVE EXAMPLE 2 | 30/80 | 7 | TWO MILLION SHEETS | −10 | −350 | −600 | 0.58 | NOT GOOD |
| EXAMPLE 3 | 30/80 | 7 | TWO MILLION SHEETS | −20 | −700 | −600 | 1.17 | GOOD |
| EXAMPLE 4 | 30/80 | 7 | NEW | −10 | −620 | −600 | 1.03 | GOOD |
| EXAMPLE 5 | 30/80 | 2 | TWO MILLION SHEETS | −10 | −570 | −600 | 0.95 | GOOD |
| EXAMPLE 6 | 30/80 | 2 | TWO MILLION SHEETS | −30 | −1150 | −600 | 1.92 | GOOD |
| EXAMPLE 7 | 20/50 | 20 | TWO MILLION SHEETS | −10 | −950 | −750 | 1.27 | GOOD |

FIG. 5

| | NUMBER OF PRINT | FRONT-END CURRENT [μA] | FRONT-END VOLTAGE [V] | SURFACE POTENTIAL [V] | FRONT-END VOLTAGE / SURFACE POTENTIAL | SEPARATION PERFORMANCE |
|---|---|---|---|---|---|---|
| EXAMPLE 8 | 0 | −30 | −650 | −600 | 1.08 | GOOD |
| | 20 | −22 | −630 | −600 | 1.05 | GOOD |
| | 50 | −18 | −630 | −600 | 1.05 | GOOD |
| | 100 | −15 | −670 | −600 | 1.12 | GOOD |
| | 300 | −10 | −600 | −600 | 1.00 | GOOD |
| | 300 | −30 | −1200 | −600 | 2.00 | GOOD |
| COMPARATIVE EXAMPLE 8 | 0 | −10 | −250 | −600 | 0.42 | NOT GOOD |
| | 20 | −10 | −350 | −600 | 0.58 | NOT GOOD |
| | 50 | −10 | −420 | −600 | 0.70 | NOT GOOD |
| | 100 | −10 | −500 | −600 | 0.83 | NOT GOOD |
| | 300 | −10 | −600 | −600 | 1.00 | GOOD |

FIG. 6

IMAGE FORMING APPARATUS AND METHOD OF CONTROLLING IMAGE FORMING APPARATUS FOR SEPARATING A RECORDING SHEET FROM AN IMAGE BEARING MEMBER

CROSS REFERENCE TO RELATED APPLICATIONS

This application is entitled and claims the benefit of Japanese Patent Application No. 2013-058046, filed on Mar. 21, 2013, the disclosure of which including the specification, drawings and abstract is incorporated herein by reference in its entirety.

BACKGROUND OF THE INVENTION

1. Field of the Invention

The present invention relates to an image forming apparatus and a method of controlling the image forming apparatus.

2. Description of Related Art

In recent years, belt-transfer type image forming apparatuses are known. In the belt-transfer type image forming apparatuses, a transfer belt travels in contact with a photoconductor drum, and a recording sheet is conveyed in synchronization with a toner image formed on the photoconductor drum. A transfer voltage having a polarity opposite to a charging polarity of toner (transfer polarity) is applied to the transfer belt to transfer the toner image on the photoconductor drum onto the recording sheet by electrostatic attraction.

However, belt-transfer type image forming apparatuses have the following problems. Specifically, when the transfer belt is left in a high humidity environment for long periods of time, the transfer belt absorbs moisture in the air, and the electric resistance thereof decreases. FIG. 7 is a graph of variation in surface resistance of a transfer belt versus leaving time under a high humidity environment (30[° C.] and 80[%]). Curve L0 represents variations in surface resistance of a new transfer belt, and curve L1 represents variations in surface resistance of a transfer belt which has been used for printing two million sheets. In both transfer belts, the longer the leaving time under a high humidity environment, the lower the resistance value thereof.

When the surface resistance of a transfer belt decreases, the transfer electric charge of the front-end of a recording sheet diffuses, and thus the adsorption force between the transfer belt and the front-end of the recording sheet is reduced and a performance of separating recording sheets from the photoconductor drum is considerably degraded. In addition, when the use history (for example, the total number of sheets printed by an image forming apparatus) of a transfer belt increases, the performance of separating a recording sheet tends to be further degraded since discharge products and the like are formed on the inner periphery surface of the transfer belt and thus the hygroscopic property of the transfer belt is increased.

Further, the resistance value of the transfer belt and the photoconductor drum, and a transfer electric field that acts on the front-end portion of a recording sheet are varied by many parameters such as humidity, the leaving time of the transfer belt, the use history of the transfer belt, and the number of outputs since the start of printing. Therefore, it is difficult to control the performance of separating recording sheets from the photoconductor drum under a high humidity environment.

FIG. 8 is a graph of variation in separation failure rate (which is referred to also as "separation jam rate") versus leaving time under a high humidity environment (30[° C.] and 80[%]). Curve L2 illustrates a variation in separation failure rate in the case where a new transfer belt is used, and curve L3 illustrates a variation in separation failure rate in the case where a transfer belt which has been used for printing two million sheets is used. In both cases, as the leaving time under a high humidity environment is prolonged, the separation failure rate is increased.

Japanese Patent Application Laid-Open No. 2003-57966 discloses a technique in which the timing of front-end transfer current switching and an inter-paper transfer current value are brought under switching control in accordance with the resistance value of transfer conveyance means (transfer belt), to thereby improve the performance of separating the transfer sheet from a photoconductor. According to the technique disclosed in Japanese Patent Application Laid-Open No. 2003-57966, when the resistance value of the transfer belt is small, the timing of the front-end transfer current switching is delayed, and at the same time the inter-paper transfer current value is decreased.

In the technique disclosed in the above-mentioned Japanese Patent Application Laid-Open No. 2003-57966, the adsorption force between a transfer sheet and a photoconductor may possibly be decreased, without supplying electric charges to the transfer sheets more than necessary (without overcharging the transfer sheets). However, the direction of the electric field generated between the transfer sheet and the photoconductor is a direction in which the transfer sheet and the photoconductor attract each other, albeit weakly, and therefore the adsorption force between the transfer sheet and the transfer belt may be undesirably decreased at the same time. Therefore, the effect of improving the performance of separating a sheet from the photoconductor cannot be sufficiently obtained by the technique disclosed in Japanese Patent Application Laid-Open No. 2003-57966.

SUMMARY OF THE INVENTION

An object of the present invention is to provide an image forming apparatus capable of improving the performance of separating a recording sheet from an image bearing member in the case where the image forming apparatus has been left in a high humidity environment for long periods of time, and a method of controlling the image forming apparatus.

To achieve the above-mentioned object, an image forming apparatus reflecting one aspect of the present invention includes: a rotatable image bearing member that bears a toner image; a transferring member that forms a transfer nip portion with the image bearing member; a voltage application section that applies a voltage to the transferring member in such a manner that a certain amount of current flows through the transferring member; and a control section that sets a front-end current to a current that flows through the transferring member when a voltage having a polarity opposite to a transfer polarity and an absolute value substantially the same as or greater than an absolute value of a surface potential of the image bearing member is applied to the transferring member by the voltage application section, the control section controlling the voltage application section in such a manner that the set front-end current flows through the transferring member when a front-end portion of a recording sheet in a conveyance direction passes through the transfer nip portion.

Desirably, in the image forming apparatus, the control section sets the front-end current to a current that flows through the transferring member when a voltage having a polarity opposite to a transfer polarity and an absolute value equal to or greater than the absolute value of the surface potential is applied to the transferring member.

Desirably, in the image forming apparatus, the control section sets the front-end current to a current that flows through the transferring member when a voltage having a polarity opposite to a transfer polarity is applied to the transferring member, a ratio of the voltage to the surface potential being 0.9 or greater in absolute value.

Desirably, in the image forming apparatus, the control section controls the voltage application section in such a manner that the front-end current flows through the transferring member during a period from a time when the front-end portion of the recording sheet in the conveyance direction starts to pass through the transfer nip portion until a time when the front-end portion of the recording sheet passes the transfer nip portion.

Desirably, in the image forming apparatus, the control section sets the front-end current to a current that flows through the transferring member when a voltage having a polarity opposite to the transfer polarity and an absolute value substantially the same or greater than the absolute value of the surface potential is applied to the transferring member in a state where the recording sheet does not exist in the transfer nip portion.

Desirably, in the image forming apparatus, the image forming apparatus further includes a surface potential measuring section that measures a surface potential of the image bearing member, wherein the control section acquires a surface potential of the image bearing member on the basis of a measurement result of the surface potential measuring section.

Desirably, in the image forming apparatus, the image forming apparatus further includes a charging section that charges a surface of the image bearing member, wherein the control section estimates a surface potential of the image bearing member on the basis of a charging grid voltage applied to the charging section when the surface of the image bearing member is charged.

Desirably, in the image forming apparatus, the image forming apparatus further includes a charging section that charges a surface of the image bearing member, wherein the control section estimates a surface potential of the image bearing member on the basis of a charging current that flows from the charging section to the image bearing member when the surface of the image bearing member is charged.

In a method of controlling an image forming apparatus reflecting another aspect of the present invention, the image forming apparatus includes: a rotatable image bearing member that bears a toner image; a transferring member that forms a transfer nip portion with the image bearing member; and a voltage application section that applies a voltage to the transferring member in such a manner that a certain amount of current flows through the transferring member, the method including controlling the voltage application section in such a manner that a front-end current flows through the transferring member when a front-end portion of a recording sheet in a conveyance direction passes through the transfer nip portion, the front-end current being set to a current that flows through the transferring member when a voltage having a polarity opposite to a transfer polarity and an absolute value substantially the same as or greater than an absolute value of a surface potential of the image bearing member is applied to the transferring member by the voltage application section.

Desirably, in the controlling, the front-end current is set to a current that flows through the transferring member when a voltage having a polarity opposite to a transfer polarity and an absolute value equal to or greater than the absolute value of the surface potential is applied to the transferring member.

Desirably, in the controlling, the front-end current is set to a current that flows through the transferring member when a voltage having a polarity opposite to a transfer polarity is applied to the transferring member, a ratio of the voltage to the surface potential being 0.9 or greater in absolute value.

Desirably, in the controlling, the voltage application section is controlled in such a manner that the front-end current flows through the transferring member during a period from a time when the front-end portion of the recording sheet in the conveyance direction starts to pass through the transfer nip portion until a time when the front-end portion of the recording sheet passes the transfer nip portion.

Desirably, in the controlling, the front-end current is set to a current that flows through the transferring member when a voltage having a polarity opposite to the transfer polarity and an absolute value substantially the same or greater than the absolute value of the surface potential is applied to the transferring member in a state where the recording sheet does not exist in the transfer nip portion.

Desirably, in the controlling, the image forming apparatus further includes a surface potential measuring section that measures a surface potential of the image bearing member, and a surface potential of the image bearing member is acquired on the basis of a measurement result of the surface potential measuring section.

Desirably, in the controlling, the image forming apparatus further comprises a charging section that charges a surface of the image bearing member, and, a surface potential of the image bearing member is estimated on the basis of a charging grid voltage applied to the charging section when the surface of the image bearing member is charged.

Desirably, in the controlling, the image forming apparatus further includes a charging section that charges a surface of the image bearing member, and, a surface potential of the image bearing member is estimated on the basis of a charging current that flows from the charging section to the image bearing member when the surface of the image bearing member is charged.

BRIEF DESCRIPTION OF DRAWINGS

The present invention will become more fully understood from the detailed description given hereinbelow and the appended drawings which are given by way of illustration only, and thus are not intended as a definition of the limits of the present invention, and wherein:

FIG. 5 is a table illustrating results of Experiment 1 for determining the effectiveness of the present invention;

FIG. 6 is a table illustrating results of Experiment 2 for determining the effectiveness of the present invention;

DESCRIPTION OF THE PREFERRED EMBODIMENTS

In the following, an embodiment of the present invention is described in detail with reference to the drawings.

[Configuration of Image Forming Apparatus 100]

Figure 1:
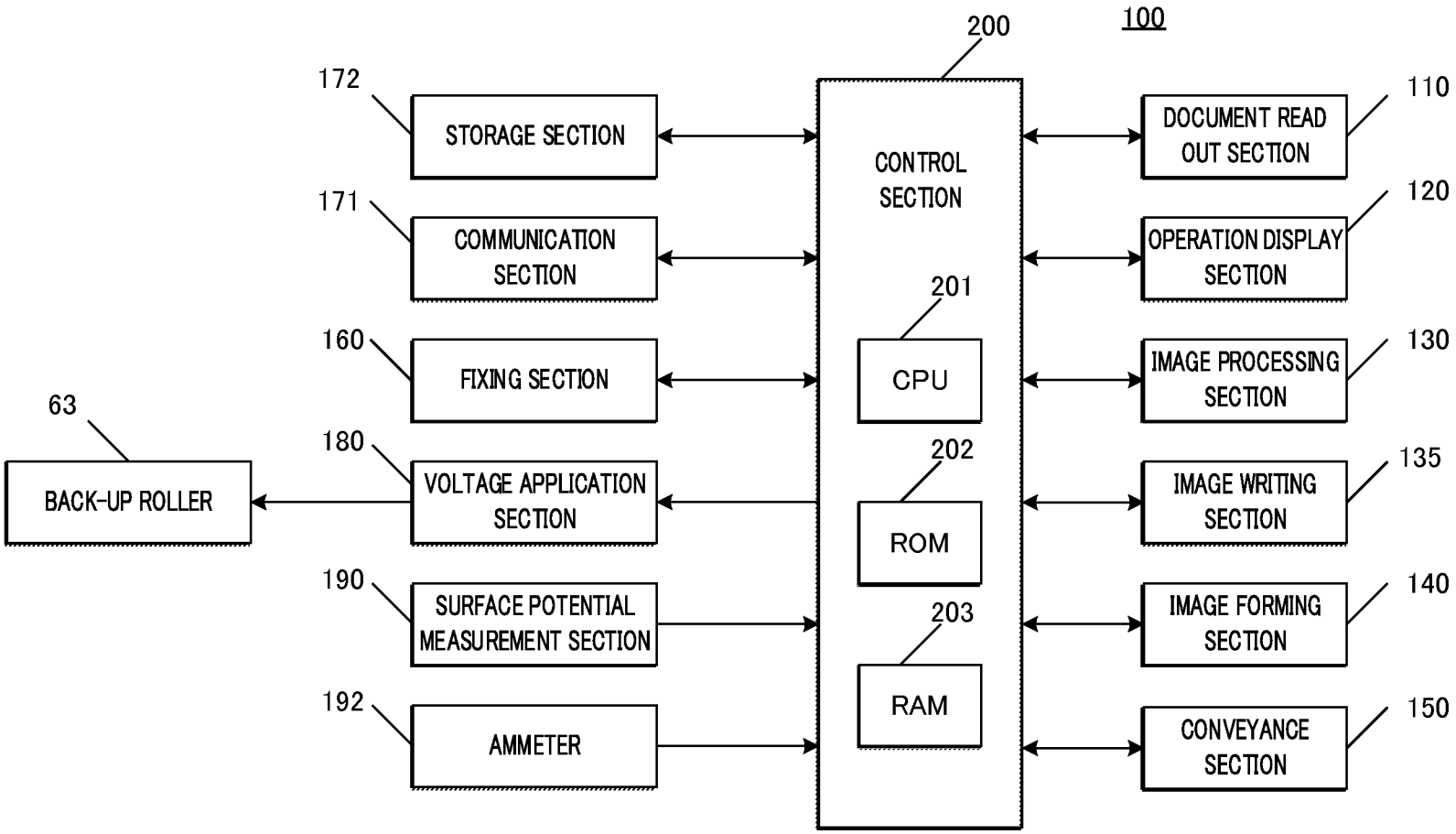
FIG. 1 is a control block diagram of an image forming apparatus in the present embodiment.

Image forming apparatus 100 illustrated in FIG. 1 forms an image on a recording sheet by using the electrophotographic process. As illustrated in FIG. 1, image forming apparatus 100 includes document read out section 110, operation display section 120, image processing section 130, image writing section 135, image forming section 140, conveyance section 150, fixing section 160, communication section 171, storage section 172, voltage application section 180, surface potential measuring section 190, and control section 200. Back-up roller 63, voltage application section 180, and ammeter 192 will be described later.

Control section 200 includes Central Processing Unit (CPU) 201, Read Only Memory (ROM) 202, Random Access Memory (RAM) 203, and the like. CPU 201 reads out a program corresponding to the processing to be performed from ROM 202 and loads the program in RAM 203, and controls the operation of each block of image forming apparatus 100 in conjunction with the loaded program. At this time, various kinds of data stored in storage section 172 are referenced. Storage section 172 is composed of a nonvolatile-semiconductor memory (so-called flash memory) or a hard disk drive, for example.

Control section 200 exchanges various kinds of data, via communication section 171, with an external apparatus (for example, a personal computer) connected through a communication network such as local area network (LAN) and wide area network (WAN). For example, control section 200 receives image data sent from the external apparatus, and forms an image on a recording sheet based on the received image data. Communication section 171 is composed of a communication control card such as a LAN card, for example.

Document read out section 110 optically scans a document conveyed onto a contact glass and brings light reflected from a document into an image on a light reception surface of charge coupled device (CCD) sensor, thereby reading out the image of the document. It is to be noted that, while the document is conveyed onto the contact glass by an automatic document feeder (ADF), the document may be manually placed on the contact glass.

Operation display section 120 includes a touch screen. Users can input various kinds of instructions and settings from the touch screen. Pieces of information relating to the instructions and settings are dealt by control section 200 as job information. The job information includes, for example, sheet size, number of sheets to be printed, and the like.

Image processing section 130 includes a circuit for performing analog-to-digital (A/D) conversion processing and a circuit for performing digital image processing. Image processing section 130 performs A/D conversion processing on an analog image signal acquired by a CCD sensor of document read out section 110 to generate digital image data, and outputs the generated digital image data to image writing section 135.

Image writing section 135 emits laser light based on the digital image data generated by image processing section 130, and irradiates a photoconductor drum of image forming section 140 with the emitted laser light to form an electrostatic latent image on the photoconductor drum (light exposure step).

Image forming section 140 includes configurations for carrying out steps including, in addition to the above-mentioned light exposure step, a charging step that is performed prior to the light exposure step, a development step that is performed after the light exposure step, a transferring step subsequent to the development step, and a cleaning step subsequent to the transferring step. In the charging step, image forming section 140 uses corona discharge from a charging device to uniformly charge the surface of the photoconductor drum. In the development step, image forming section 140 causes toner contained in a developer in a developing device to adhere to an electrostatic latent image on the photoconductor drum, and thus forms a toner image on the photoconductor drum.

In the transferring step, image forming section 140 transfers the toner image on the photoconductor drum onto a recording sheet conveyed by conveyance section 150 when a transfer voltage is applied from voltage application section 180. In the cleaning step, image forming section 140 brings a cleaning device such as a brush into contact with the photoconductor drum, to thereby remove toner remaining on the photoconductor drum after the transferring step.

Fixing section 160 includes a fixing roller and a pressure roller. The pressure roller is disposed in pressure contact with the fixing roller. A fixing nip portion is formed at a portion where the fixing roller and the pressure roller make pressure contact with each other. Fixing section 160 applies heat and pressure to the toner image on a recording sheet conveyed into the fixing nip portion (thermal fixing), to thereby fix the toner image on the recording sheet (fixing step). As a result, a fixed toner image is formed on the recording sheet. The recording sheet subjected to the thermal fixation at fixing section 160 is ejected out of image forming apparatus 100.

Surface potential measuring section 190 is, for example, a surface potential sensor, and is disposed in the proximity of photoconductor drum 1. Surface potential measuring section 190 measures, in a noncontact manner, the potential (surface potential) on the surface of photoconductor drum 1 which has been charged by the corona discharge from the charging device, and then outputs a measurement signal thus obtained to control section 200.

Figure 2:
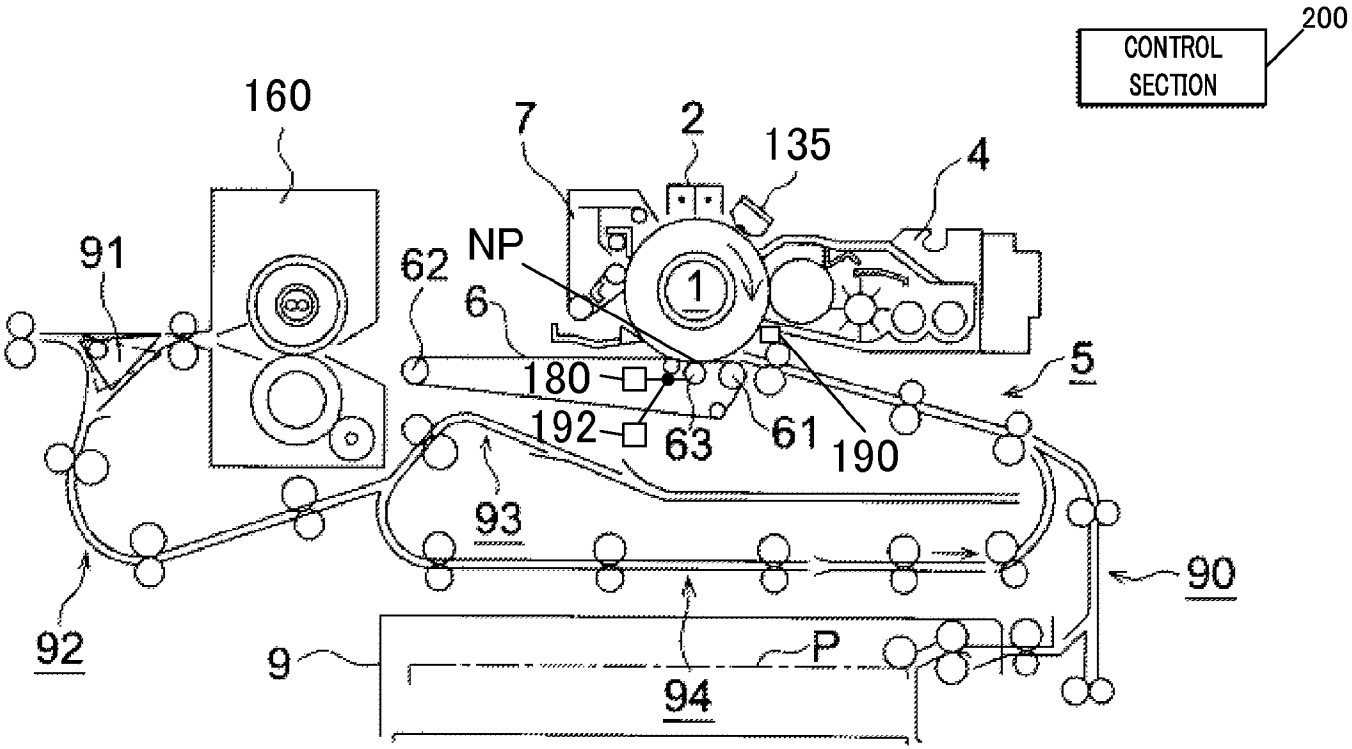
FIG. 2 illustrates a detailed configuration of an image forming section and its surroundings in the present embodiment.

Next, referring to FIG. 2, a configuration of image forming section 140 and its surroundings will be described in detail. In FIG. 2, the reference number 1 represents a photoconductor drum functioning as an image bearing member, and along the rotational direction of photoconductor drum 1 (arrow direction), there are provided charging device 2 functioning as a charging section, image writing section 135, developing device 4, surface potential measuring section 190, transfer conveyance path 5 that introduces recording sheet P to a transfer region, transfer belt 6 (transferring member) that transfers a toner image formed on photoconductor drum 1 to recording sheet P, and cleaning device 7 that removes toner remaining on photoconductor drum 1. In addition, on the downstream side in the direction in which recording sheets are conveyed on transfer belt 6, fixing section 160 is provided so as to fix the toner image of recording sheet P.

Transfer belt 6 is formed in such a manner that the surface of a base material composed of a chloroprene rubber having a thickness of 0.5 [mm] and the like is coated with PTFE (polytetrafluoroethylene) having a thickness of 3 [μm] as a coating layer. Under a certain environment (temperature: 20[° C], relative humidity: 50[%] and voltage application: 500

[V]), transfer belt 6 has a volume resistivity of 9.5 [log ($=10^{9.5}$)Ω·cm], and a surface resistance of 10.5 [log($=10^{10.5}$) Ω/□].

Transfer belt 6 is installed around driven roller 61, driving roller 62 and other rollers in a stretched state, and is disposed below photoconductor drum 1 in such a manner that the surface of transfer belt 6 is in contact with part of the outer peripheral surface of photoconductor drum 1. That is, transfer nip portion NP as a transfer region is formed between transfer belt 6 and photoconductor drum 1. Recording sheet P is conveyed while it is pressed against photoconductor drum 1 by transfer belt 6 at transfer nip portion NP.

On the internal side of transfer belt 6 that makes contact with part of the outer peripheral surface of photoconductor drum 1, back-up roller 63 capable of applying a transfer voltage to transfer belt 6 is disposed. Back-up roller 63 is connected to voltage application section 180 as a power source that applies a transfer voltage to transfer belt 6. Control section 200 controls a voltage to be applied by voltage application section 180 such that a predetermined current is passed from back-up roller 63 to voltage application section 180. More specifically, control section 200 measures a current flowing between voltage application section 180 and back-up roller 63 by ammeter 192, and on the basis of a current thus measured, controls voltage application section 180. When a positive transfer voltage is applied to transfer belt 6, a negative toner image on photoconductor drum 1 is transferred onto recording sheet P in contact with photoconductor drum 1. Control section 200 controls voltage application section 180 when recording sheet P passes through transfer nip portion NP, to thereby change the value of the voltage applied to transfer belt 6.

Recording sheet P is stored in sheet feeding cassette 9, and fed to transfer conveyance path 5 through sheet conveyance path 90. On the downstream side of fixing section 160, gate 91 is provided for switching between ejection of recording sheet P to the outside and feeding of recording sheet P to duplex conveyance path 92 for duplex printing. Recording sheet P having entered duplex conveyance path 92 is temporarily advanced to inversion conveyance path 93, and inverted in inversion conveyance path 93, and thereafter, advanced into transfer conveyance path 5 from re-feeding conveyance path 94.

Next, operation of switching the value of a voltage applied to transfer belt 6 when recording sheet P passes through transfer nip portion NP will be described with reference to FIG. 3A.

Before a toner image is formed on recording sheet P, control section 200 sets a front-end current to a current that flows through the transfer belt 6 when a voltage having a polarity opposite to the transfer polarity (negative polarity) and an absolute value equal to or greater than the absolute value of a surface potential of photoconductor drum 1 (hereinafter referred to as "front-end voltage") is applied to transfer belt 6 by voltage application section 180. Then, as illustrated in FIG. 3A, control section 200 controls voltage application section 180 such that the front-end current set in the above-mentioned manner flows through transfer belt 6 when a region including the front-end portion and its surroundings (which ranges from A to B) as a non-image region of recording sheet P represented by the dotted line passes through transfer nip portion NP. That is, control section 200 controls voltage application section 180 to apply, to transferring member belt 6, a front-end voltage having an absolute value equal to or greater than the absolute value of the surface potential of photoconductor drum 1.

Thus, a dielectric polarization occurs at the front-end portion of recording sheet P (dielectric), and, on recording sheet P, a positive electric charge is concentrated on a side opposite to transfer belt 6 while a negative electric charge is concentrated on the other side opposite to photoconductor drum 1. As a result, at the front-end portion of recording sheet P, the side opposite to transfer belt 6 (positive polarity) and transfer belt 6 (negative polarity) tend to electrostatically attract each other, while the side opposite to photoconductor drum 1 (negative polarity) and photoconductor drum 1 (negative polarity) tend to electrostatically repel each other. Thus, the adsorption force between transfer belt 6 and the front-end portion of recording sheet P is increased, and consequently the performance of separating the front-end portion of recording sheet P from photoconductor drum 1 can be improved.

Meanwhile, in the case where transfer belt 6 has been left in an environment of a certain absolute humidity (for example, 1500 [g/m$^3$]) or greater for more than a certain period (for example, five hours), the electric resistance of transfer belt 6 decreases since transfer belt 6 absorbs moisture in the air, and as a result, a large current may flow through transfer belt 6 in response to application of a small voltage. In this case, as illustrated in FIG. 3B, when voltage application section 180 is controlled in such a manner that the front-end current set in advance flows through transfer belt 6 when a region including the front-end portion and its surroundings (which ranges from A to B) of recording sheet P passes through transfer nip portion NP, a voltage having a polarity opposite to the transfer polarity and an absolute value smaller than the absolute value of the surface potential of photoconductor drum 1 is applied to transfer belt 6. Even in this case, a dielectric polarization occurs at the front-end portion of recording sheet P; however, in recording sheet P, a negative electric charge is concentrated on the side opposite to transfer belt 6, and a positive electric charge is concentrated on the side opposite to photoconductor drum 1, unlike the case of FIG. 3A. As a result, at the front-end portion of recording sheet P, the side opposite to transfer belt 6 (negative polarity) and transfer belt 6 (negative polarity) tend to electrostatically repel each other, while the side opposite to photoconductor drum 1 (positive polarity) and photoconductor drum 1 (negative polarity) tend to electrostatically attract each other. Consequently, the adsorption force between transfer belt 6 and the front-end portion of recording sheet P decreases, and the performance of separating the front-end portion of recording sheet P from photoconductor drum 1 significantly decreases. In view of the above, in the present embodiment, when transfer belt 6 has been left in an environment of a certain absolute humidity or greater for more than a certain period, control section 200 controls voltage application section 180 to apply, to transferring member belt 6, a front-end voltage having a polarity opposite to the transfer polarity and an absolute value equal to or greater than an absolute value of a surface potential of photoconductor drum 1.

Figure 3A:
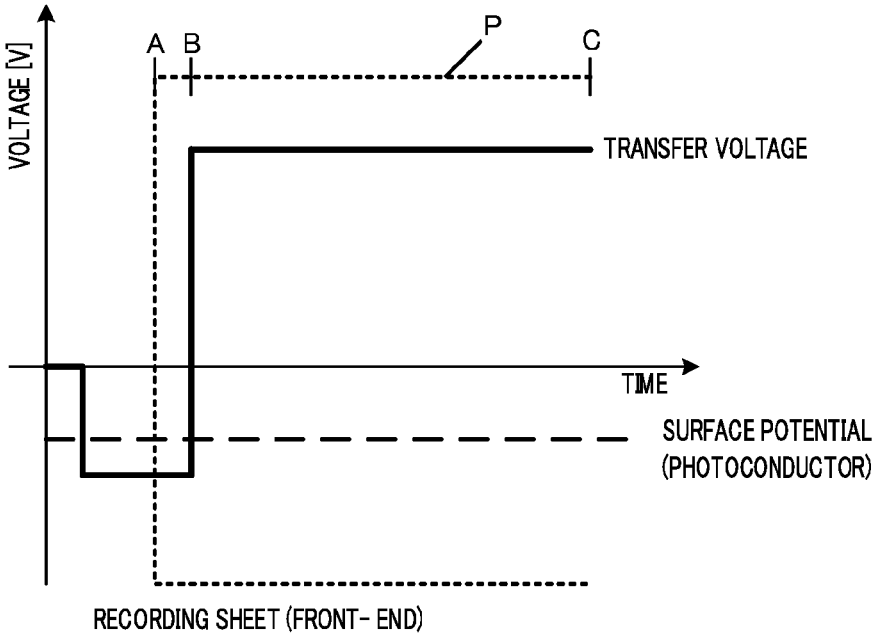
FIG. 3A illustrates a relationship between a surface potential of a photoconductor drum and a voltage value applied to a transfer belt.
Figure 3B:
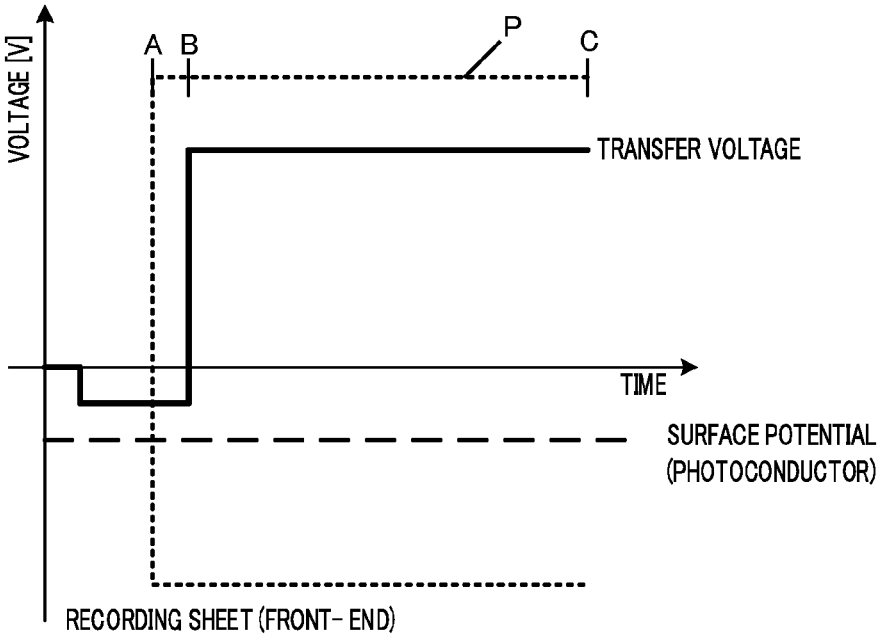
FIG. 3B illustrates a relationship between a surface potential of a photoconductor drum and a voltage value applied to a transfer belt.

In addition, as illustrated in FIG. 3A, when the region ranging from B to C which serves as an image region of recording sheet P passes through transfer nip portion NP, control section 200 controls voltage application section 180 so as to apply a positive transfer voltage to transfer belt 6, in order to transfer a toner image formed on photoconductor drum 1 to recording sheet P.

Figure 4:
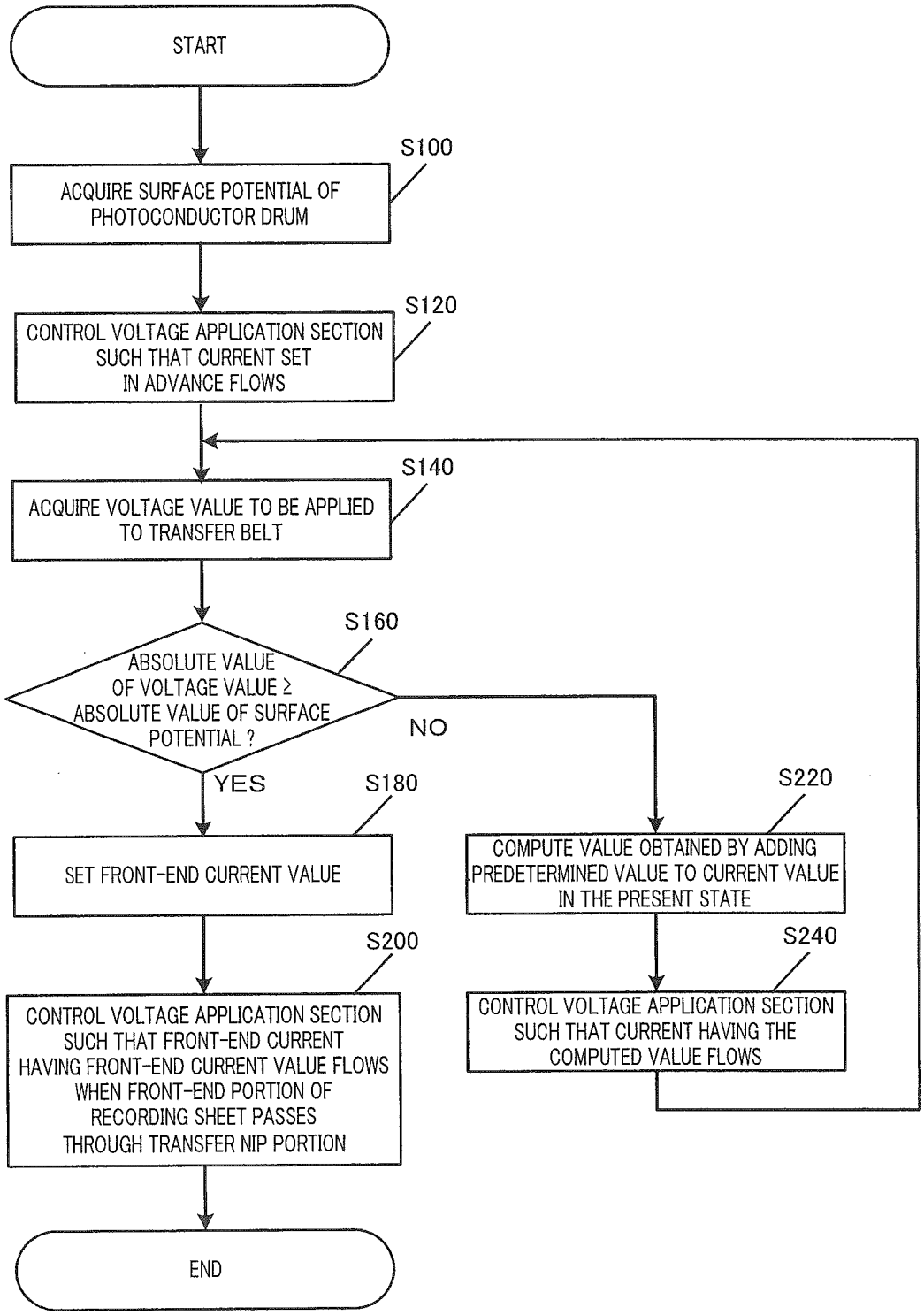
FIG. 4 is a flowchart illustrating an exemplary operation of the image forming apparatus in the present embodiment.
Figure 7:
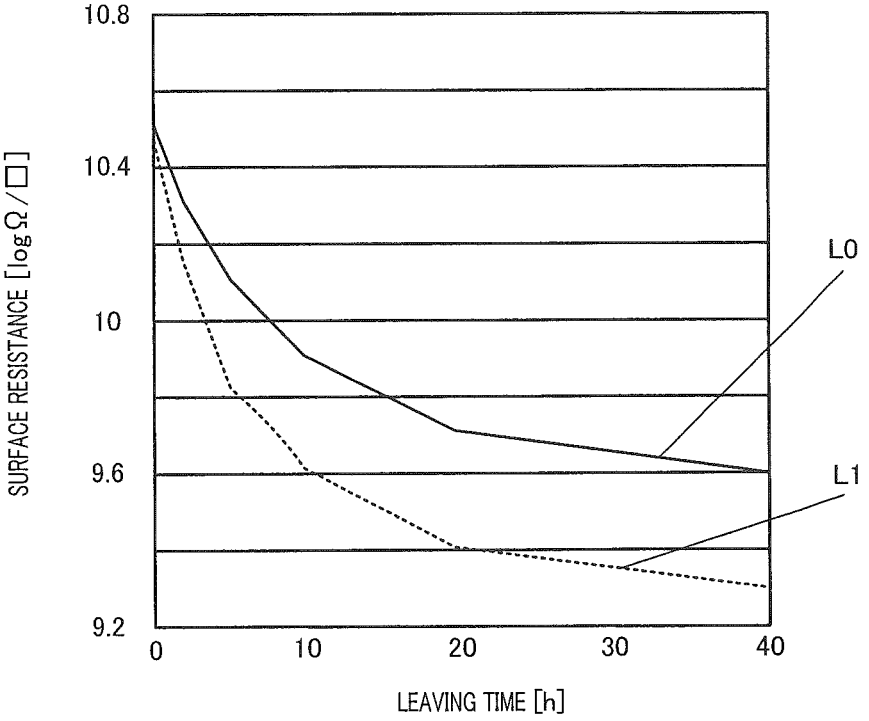
FIG. 7 is a graph of variation in surface resistance of the transfer belt versus leaving times.
Figure 8:
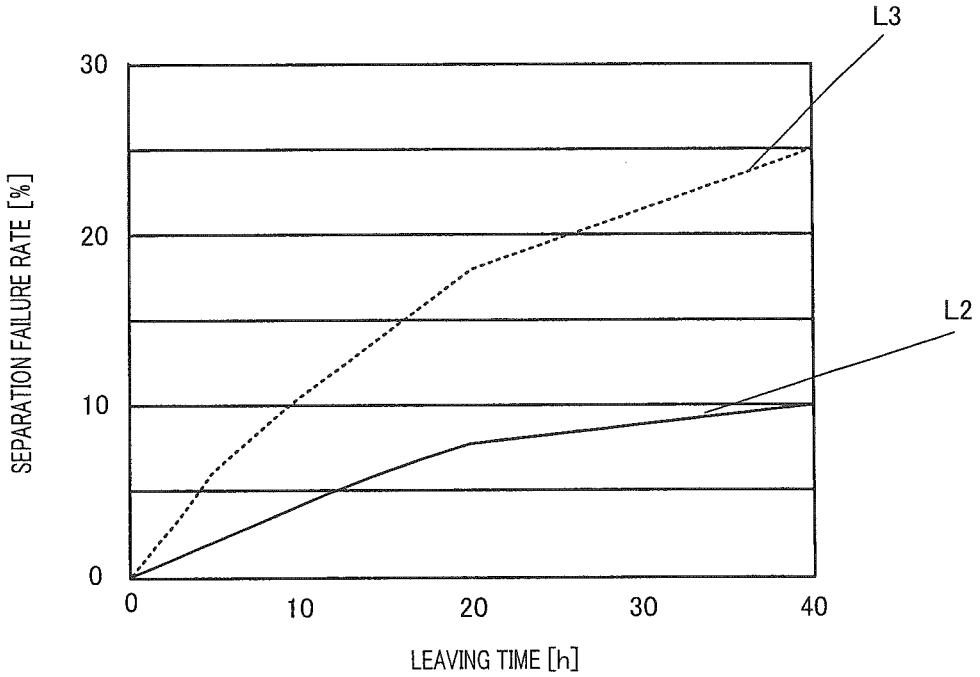
FIG. 8 is a graph of variation in separation failure rate versus leaving times.

FIG. 4 is a flowchart illustrating an exemplary control operation of image forming apparatus 100 in the present embodiment. The processing at step S100 is started when image forming apparatus 100 is turned on and activated.

First, control section 200 inputs a measurement signal output from surface potential measuring section 190, to thereby acquire a surface potential of photoconductor drum 1 (for example, -600 [V]) (step S100). Next, by referring to a measurement result of ammeter 192, control section 200 controls voltage application section 180 such that a current flowing between voltage application section 180 and back-up roller 63 has a polarity opposite to the transfer polarity and a current value set in advance (for example, −10 [μA]) (step S120).

Next, control section 200 acquires a value of a voltage to be applied to transfer belt 6 when a current having a certain current value (a current value of a current passed at step S120, or a current value of a current passed at step S240) is passed, from application section 180 (step S140). Next, control section 200 determines whether the absolute value of the voltage value acquired from voltage application section 180 is equal to or greater than the absolute value of the surface potential of photoconductor drum 1 acquired from surface potential measuring section 190 (step S160). When it is determined that the absolute value of the voltage value is equal to or greater than the absolute value of the surface potential of photoconductor drum 1 (step S160, YES), control section 200 sets a front-end current value to a value of a current that flows between voltage application section 180 and back-up roller 63 and then through transfer belt 6 when the voltage is applied to transfer belt 6 (step S180).

Finally, control section 200 controls voltage application section 180 such that the front-end current having a value set as the front-end current value at step S180 flows through transfer belt 6 when the front-end portion of recording sheet P in the conveyance direction passes through transfer nip portion NP after an image formation process of image forming apparatus 100 is started (step S200). Upon completion of the processing of step S200, image forming apparatus 100 terminates the processing of FIG. 4.

Back in the determination process at step S160, when it is determined that the absolute value of the voltage value is not equal to or greater than the absolute value of the surface potential of photoconductor drum 1 (step S160, NO), control section 200 computes a value obtained by adding a predetermined value (for example, −5 [μA]) to the value of a current (the current value in the present state) that flows through transfer belt 6 when the voltage is applied to transfer belt 6 (step S220). Next, while referring to the detection result of ammeter 192, control section 200 controls voltage application section 180 such that the value of the current that flows between voltage application section 180 and back-up roller 63 is equal to the value computed at step S220 (for example, −15 [μA]) (step S240). Thereafter, the processing is transferred to step S140.

It is to be noted that, in the present embodiment, control section 200 sets the front-end current to a current that flows through transfer belt 6 when a voltage having a polarity opposite to the transfer polarity and an absolute value equal to or greater than an absolute value of a surface potential of photoconductor drum 1 is applied to transfer belt 6, after image forming apparatus 100 is turned on and activated and before printing is performed, in other words, when recording sheet P does not exist in transfer nip portion NP. One reason for this is that the separation performance at the front-end portion of recording sheet P has a correlation with the electric field generated when the front edge (the boundary between the portion where recording sheet P exists and the portion where recording sheet P does not exist in transfer nip portion NP) of recording sheet P passes through transfer nip portion NP, not with the electric field generated when the front-end portion passes through transfer nip portion NP to a certain degree, and thus a steady-state is established by the intervention of recording sheet P.

[Effect of the Present Embodiment]

As has been described in detail, image forming apparatus 100 in the present embodiment includes: rotatable photoconductor drum 1 that bears a toner image; transfer belt 6 that forms transfer nip portion NP in combination with photoconductor drum 1; voltage application section 180 that applies a voltage to transfer belt 6 such that a certain current flows through transfer belt 6; control section 200 that sets a front-end current to a current that flows through transfer belt 6 when a front-end voltage having a polarity opposite to the transfer polarity and an absolute value equal to or greater than an absolute value of a surface potential of photoconductor drum 1 is applied to transfer belt 6 by voltage application section 180, and controls voltage application section 180 such that the set front-end current flows through transfer belt 6 when a front-end portion of recording sheet P in the conveyance direction passes through transfer nip portion NP.

With the configuration of the present embodiment, even when image forming apparatus 100 has been left in a high humidity environment for long periods of time, electric fields are generated between photoconductor drum 1, recording sheet P and transfer belt 6 such that the front-end portion of recording sheet P and transfer belt 6 tend to electrostatically attracted each other, and that the front-end portion of recording sheet P and photoconductor drum 1 tend to electrostatically repel each other. Thus, the adsorption force between transfer belt 6 and the front-end portion of recording sheet P is increased, and consequently the performance of separating the front-end portion of recording sheet P from photoconductor drum 1 can be improved.

In addition, in the present embodiment, control section 200 controls voltage application section 180 such that a front-end current flows through transfer belt 6 during a period from a time when the front-end portion of recording sheet P in the conveyance direction starts to pass through transfer nip portion NP until a time when the front-end portion of recording sheet P passes transfer nip portion NP. With this configuration, in the entire region of the front-end portion of recording sheet P in the conveyance direction, a front-end voltage having a polarity opposite to the transfer polarity and an absolute value equal to or greater than an absolute value of a surface potential of photoconductor drum 1 is applied to transfer belt 6. Thus, in comparison with the case where the above-mentioned front-end voltage is not applied to part of the front-end portion of recording sheet P in the conveyance direction, adsorption force between transfer belt 6 and the front-end portion of recording sheet P is increased, and consequently the performance of separating the front-end portion of recording sheet P from photoconductor drum 1 can be improved.

[Modification]

It is to be noted that, in the above-mentioned embodiment, when the amount of decrease in resistance value of transfer belt 6 is small and the adsorption force between transfer belt 6 and the front-end portion of recording sheet P is not significantly decreased (for example, when the absolute humidity around transfer belt 6 is not so high, or when the leaving time of transfer belt 6 under a high humidity environment is short), the control operation of the flowchart of FIG. 4 may not be performed.

In addition, in the above-mentioned embodiment, the front-end current is set to a current that flows through the transfer belt 6 when a voltage having an absolute value equal to or greater than the absolute value of the surface potential of photoconductor drum 1 is applied to transfer belt 6 after image forming apparatus 100 is turned on and activated and before printing is performed, as the state where recording sheet P does not exist in the transfer nip portion NP. However, the present invention is not limited thereto. The front-end current may be set to a current that flows through the transfer belt 6 when a voltage having an absolute value equal to or greater than the absolute value of the surface potential of photoconductor drum 1 is applied to transfer belt 6 at the interval between recording sheets P when image forming apparatus 100 successively forms images, or, at the time when the printing job is completed as other examples of the state where recording sheet P does not exist in the transfer nip portion NP, for example.

In addition, while, in the above-mentioned embodiment, control section 200 receives the measurement signal output from surface potential measuring section 190 to thereby acquire the surface potential of photoconductor drum 1, the present invention is not limited thereto. For example, control section 200 may estimate the surface potential of photoconductor drum 1 on the basis of a charging grid voltage applied to charging device 2 that charges the surface of photoconductor drum 1. One reason for this is that the surface potential of photoconductor drum 1 is controlled at a value close to the charging grid voltage under a condition where a sufficient charging current is given. In addition, control section 200 may estimate the surface potential of photoconductor drum 1 on the basis of the charging current that flows from charging device 2 to photoconductor drum 1. The surface potential of photoconductor drum 1 is proportional to the amount of the charge discharged from the charging device to photoconductor drum 1, and therefore, when a high surface potential is required, it is necessary to set the charging current value at a large value. That is to say, the surface potential of photoconductor drum 1 can be estimated from the charging current value.

In addition, while photoconductor drum 1 functions as the image bearing member of the present invention in the above-mentioned embodiment, the present invention is not limited thereto. For example, in the case of an image forming apparatus 100 of an intermediate belt transfer type, the intermediate transfer belt may function as the image bearing member. In addition, the present invention may be applied to both of monochrome image forming apparatus 100 for forming a monochrome image and color image forming apparatus 100 for forming a color image.

It should be understood by those skilled in the art that various modifications, combinations, sub-combinations and alterations may occur depending on design requirements and other factors in so far as they are within the scope of the appended claims or the equivalents thereof

EXAMPLES

Finally, results of Experiments 1 and 2 conducted by the present inventor for determining the effectiveness of the present invention will be described.

Experiment 1

In Experiment 1, under conditions differing in use condition (temperature and relative humidity), leaving time of transfer belt 6, use history of transfer belt 6 (number of sheets printed by using transfer belt 6), value of front-end current, value of front-end voltage, and surface potential of photoconductor drum 1, 30 sheets were printed immediately after image forming apparatus 100 was turned on, and the separation performance of recording sheet P from photoconductor drum 1 (to be more specific, whether a separation jam occurred) was determined. FIG. 5 illustrates evaluations of the separation performance of recording sheet P on the basis of the evaluation criteria described below. It is to be noted that, in the printing process, recording sheet P having a basis weight of 40 [g/m$^2$] and a poor separation performance was used. In addition, the default value of the front-end current of image forming apparatus 100 was set at −10 [μA].

(Separation Performance of Recording Sheet P)

GOOD: No separation jam occurred, and the separation performance was favorable.

NOT GOOD: Separation jam occurred, and the separation performance was at a level that leads to practical problems.

As illustrated in FIG. 5, in Example 1, in addition to a long leaving time under a high humidity environment, the use history of transfer belt 6 was great, and accordingly the surface resistance of transfer belt 6 was decreased, making it difficult to ensure the separation performance of recording sheet P from photoconductor drum 1. Under such circumstances, the front-end current was set to a current (−30 [μA]) that flows through the transfer belt 6 when a front-end voltage (−650 [V]) having a polarity opposite to the transfer polarity and an absolute value equal to or greater than the absolute value of the surface potential of photoconductor drum 1 (−600 [V]) is applied to transfer belt 6 by voltage application section 180. As a result, the front-end portion of recording sheet P and transfer belt 6 tended to electrostatically attract each other, while the front-end portion of recording sheet P and photoconductor drum 1 tended to electrostatically repel each other, and thus the adsorption force between transfer belt 6 and the front-end portion of recording sheet P was increased. Therefore, the performance of separating recording sheet P from photoconductor drum 1 was favorable.

In Comparative Example 1A, the front-end current was set to a current (−10 [μA]) that flows through the transfer belt 6 when a front-end voltage (−250 [V]) having a polarity opposite to the transfer polarity and an absolute value smaller than the absolute value of the surface potential of photoconductor drum 1 (−600 [V]) is applied to transfer belt 6 by voltage application section 180. As a result, the front-end portion of recording sheet P and transfer belt 6 tended to electrostatically repel each other, while the front-end portion of recording sheet P and photoconductor drum 1 tended to electrostatically attract each other, and thus the adsorption force between transfer belt 6 and the front-end portion of recording sheet P was decreased. Therefore, the separation performance of recording sheet P from photoconductor drum 1 was at a level that leads to practical problems.

In Comparative Example 1B, although the absolute value of the front-end current was increased by 10 [μA] in comparison with Comparative Example 1A, the front-end voltage (−470 [V]) was still smaller than the surface potential of photoconductor drum 1 (−600 [V]) in absolute value. As a result, the front-end portion of recording sheet P and transfer belt 6 tended to electrostatically repel each other, while the front-end portion of recording sheet P and photoconductor drum 1 tended to electrostatically attract each other, and thus the adsorption force between transfer belt 6 and the front-end portion of recording sheet P was decreased. Therefore, the separation performance of recording sheet P from photoconductor drum 1 was at a level that leads to practical problems.

In Example 2, since the leaving time of transfer belt 6 was as short as 7 [h] in comparison with Example 1, the front-end voltage (−540 [V]) was substantially the same as the surface potential of photoconductor drum 1 (−600 [V]) in absolute value even when the front-end current was not increased to the same level as Example 1 in absolute value, and thus the separation performance of recording sheet P from photoconductor drum 1 was favorable. Here, the term "substantially the same" means that the ratio of the front-end voltage to the surface potential of photoconductor drum 1 is 0.9 or greater in absolute value even when the front-end voltage is smaller than the surface potential of photoconductor drum 1 in absolute value.

Even when the front-end voltage is substantially the same as the surface potential of photoconductor drum 1 in absolute value, a dielectric polarization occurs at the front-end portion of recording sheet P (dielectric), and, in recording sheet P, a positive electric charge is concentrated on the side opposite to transfer belt 6 while a negative electric charge is concentrated on the side opposite to photoconductor drum 1. Accordingly, at the front-end portion of recording sheet P, the side opposite to transfer belt 6 (positive polarity) and transfer belt 6 (negative polarity) tend to electrostatically attract each other, while the side opposite to photoconductor drum 1 (negative polarity) and photoconductor drum 1 (negative polarity) tend to electrostatically repel each other. Thus, the adsorption force between transfer belt 6 and the front-end portion of recording sheet P is increased, and consequently the performance of separating the front-end portion of recording sheet P from photoconductor drum 1 can be improved.

In Comparative Example 2, although the leaving time of transfer belt 6 was as short as 7 [h] in comparison with Example 1, the absolute value of the front-end current was not increased to the same level as Example 2, and thus the front-end voltage (−350 [V]) was smaller than the surface potential of photoconductor drum 1 (−600 [V]) in absolute value. As a result, the separation performance of recording sheet P from photoconductor drum 1 was at a level that leads to practical problems.

In Example 3, since the leaving time of transfer belt 6 was as short as 7 [h] in comparison with Example 1, and the absolute value of the front-end current was increased more than that in Example 2, the front-end voltage (−700 [V]) was equal to or greater than the surface potential of photoconductor drum 1 (−600 [V]) in absolute value. As a result, the separation performance of recording sheet P from photoconductor drum 1 was favorable.

In Example 4, since the leaving time of transfer belt 6 was as short as 7 [h] in comparison with Example 1, and the use history of transfer belt 6 was 0 (new), the front-end voltage (−620 [V]) was equal to or greater than the surface potential of photoconductor drum 1 (−600 [V]) in absolute value even when the absolute value of the front-end current was not increased from the default value. As a result, the separation performance of recording sheet P from photoconductor drum 1 was favorable.

In Example 5, since the leaving time of transfer belt 6 was as short as 2 [h], the front-end voltage (−570 [V]) was substantially the same as the surface potential of photoconductor drum 1 (−600 [V]) in absolute value even when the absolute value of the front-end current was not increased from the default value. As a result, the separation performance of recording sheet P from photoconductor drum 1 was favorable.

In Example 6, since the absolute value of the front-end current was increased in comparison with Example 5, the front-end voltage (−1150 [V]) was equal to or greater than the surface potential of photoconductor drum 1 (−600 [V]) in absolute value. As a result, the separation performance of recording sheet P from photoconductor drum 1 was favorable. It is to be noted that, when the front-end voltage is excessively greater than the surface potential of photoconductor drum 1 in absolute value, the speed of the change from the negative front-end voltage to the positive transfer voltage may decrease, and consequently the image void (transfer void) may undesirably occur in the image region near the front-end portion of recording sheet P. Accordingly, it is preferable that the front-end voltage be not excessively greater than the surface potential of photoconductor drum 1 in absolute value.

In Example 7, while the leaving time was as long as 20 [h] and the use history of transfer belt 6 was great, the humidity was normal, and thus, the front-end voltage (−950 [V]) was equal to or greater than the surface potential of photoconductor drum 1 (−750 [V]) in absolute value even when the absolute value of the front-end current was not increased from the default value. As a result, the separation performance of recording sheet P from photoconductor drum 1 was favorable. It is to be noted that, in comparison with the case of high humidity environments, the charging amount of toner increases under normal humidity environments. Therefore, the development potential for developing a predetermined amount of toner on photoconductor drum 1 was set at a high level, and accordingly, the surface potential of photoconductor drum 1 for preventing development in a non-image region was also set at a high level.

Experiment 2

In Experiment 2, in a condition where transfer belt 6 has been left in a high humidity environment (30[° C.]/80[%]) for long periods of time (20 [h]) and transfer belt 6 has been used for printing two million sheets, 300 sheets were printed, and the separation performance of recording sheet P from photoconductor drum 1 (to be more specific, whether separation jam has occurred) was determined every time when the printing process for a predetermined number of sheets has been completed. FIG. 6 illustrates evaluations of the separation performance of recording sheet P on the basis of the evaluation criteria described below. It is to be noted that, in the printing process, recording sheet P having a basis weight of 40 [g/m$^2$] and a poor separation performance was used. In addition, the default value of the front-end current of image forming apparatus 100 was set at −10 [μA].

(Separation Performance of Recording Sheet P)

GOOD: No separation jam occurred, and the separation performance was favorable.

NOT GOOD: Separation jam occurred, and the separation performance was at a level that leads to practical problems.

In Example 8, the front-end current was set to a current that flows through transfer belt 6 when a front-end voltage having a polarity opposite to the transfer polarity and an absolute value equal to or greater than the absolute value of the surface potential of photoconductor drum 1 (−600 [V]) is applied to transfer belt 6 by voltage application section 180 at intervals of sheets after a predetermined number of sheets were printed. As a result, the front-end portion of recording sheet P and transfer belt 6 tended to electrostatically attract each other, while the front-end portion of recording sheet P and photoconductor drum 1 tended to electrostatically repel each other, and the adsorption force between transfer belt 6 and the front-end portion of recording sheet P was increased. Therefore, the performance of separating recording sheet P from photoconductor drum 1 was favorable. It is to be noted that, as the number of printing increases, the temperature around transfer belt 6 increases, that is, transfer belt 6 is dehumidified and the resistance value thereof is increased. Therefore, with the increase in number of printing, the absolute value of the front-end current to be set decreases even when the value of the voltage to be applied to transfer belt 6 is not greatly varied.

It is to be noted that, the resistance value of transfer belt 6 was not varied after 300 sheets have been printed (restored state), and the correction of the value of the front-end current from the default value became unnecessary. As illustrated in FIG. 6, when the value of the front-end current after printing 300 sheets is set at the same value as the value at the start of the printing (−30 [μA]), the front-end voltage is excessively greater than the surface potential of photoconductor drum 1 in absolute value. In this case, the speed of the change from the negative front-end voltage to the positive transfer voltage is decreased, and consequently the image void (transfer void) may undesirably occur at the image region near the front-end portion of recording sheet P. Accordingly, it is preferable that the front-end voltage be not excessively greater than the surface potential of photoconductor drum 1 in absolute value.

In Comparative Example 8, the front-end current value was not corrected at the intervals of sheets after a predetermined number of sheets were printed, and the front-end current value was consistently set at a default value (−10 [μA]). In this case, as described in Example 8, transfer belt 6 was dehumidified and the resistance value thereof was gradually increased during the printing process for 300 sheets, and as a result, the absolute value of front-end voltage was gradually increased. However, the front-end voltage was always smaller than the surface potential of photoconductor drum 1 in absolute value until 300 sheets were printed. As a result, the front-end portion of recording sheet P and transfer belt 6 tended to electrostatically repel each other, while the front-end portion of recording sheet P and photoconductor drum 1 tended to electrostatically attract each other, and the adsorption force between transfer belt 6 and the front-end portion of recording sheet P was decreased. Therefore, the separation performance of recording sheet P from photoconductor drum 1 was at a level that leads to practical problems. After 300 sheets were printed, the front-end voltage was at the same value as the surface potential of photoconductor drum 1 in absolute value. As a result, the separation performance of recording sheet P from photoconductor drum 1 was favorable.

What is claimed is:

1. An image forming apparatus comprising:

a rotatable image bearing member that bears a toner image;

a transferring member that forms a transfer nip portion with the image bearing member;

a voltage application section structured to apply a voltage to the transferring member in such a manner that a certain amount of current flows through the transferring member; and a control section structured to set a front-end current to a current that flows through the transferring member when a voltage having a polarity opposite to a transfer polarity and an absolute value substantially the same as or greater than an absolute value of a surface potential of the image bearing member is applied to the transferring member by the voltage application section based on a surface potential of the image bearing member, the control section comparing an applied voltage to flow a preset front-end current with respect to the transferring member and the surface potential of the image bearing member, the control section changing the front-end current in such a manner that the voltage is not substantially the same as or greater than the surface potential if the voltage is not substantially the same as or greater than the surface potential, the control section controlling the voltage application section in such a manner that the changed front-end current flows through the transferring member when a front-end portion of a recording sheet in a conveyance direction passes through the transfer nip portion.

2. The image forming apparatus according to claim 1, wherein the control section is structured to set the front-end current to a current that flows through the transferring member when a voltage having a polarity opposite to a transfer polarity and an absolute value equal to or greater than the absolute value of the surface potential is applied to the transferring member.

3. The image forming apparatus according to claim 1, wherein the control section is structured to set the front-end current to a current that flows through the transferring member when a voltage having a polarity opposite to a transfer polarity is applied to the transferring member, and a ratio of the voltage to the surface potential is 0.9 or greater in absolute value.

4. The image forming apparatus according to claim 1, wherein the control section is structured to control the voltage application section in such a manner that the front-end current flows through the transferring member during a period from a time when the front-end portion of the recording sheet in the conveyance direction starts to pass through the transfer nip portion until a time when the front-end portion of the recording sheet passes the transfer nip portion.

5. The image forming apparatus according to claim 1, wherein the control section is structured to set the front-end current to a current that flows through the transferring member when a voltage having a polarity opposite to the transfer polarity and an absolute value substantially the same or greater than the absolute value of the surface potential is applied to the transferring member in a state where the recording sheet does not exist in the transfer nip portion.

6. The image forming apparatus according to claim 1 further comprising a surface potential measuring section structured to measure a surface potential of the image bearing member, wherein the control section is structured to acquire a surface potential of the image bearing member on the basis of a measurement result of the surface potential measuring section.

7. The image forming apparatus according to claim 1 further comprising a charging section structured to charge a surface of the image bearing member, wherein the control section is structured to estimate a surface potential of the image bearing member on the basis of a charging grid voltage applied to the charging section when the surface of the image bearing member is charged.

8. The image forming apparatus according to claim 1 further comprising a charging section structured to charge a surface of the image bearing member, wherein the control section estimates a surface potential of the image bearing member on the basis of a charging current that flows from the charging section to the image bearing member when the surface of the image bearing member is charged.

9. A method of controlling an image forming apparatus, the image forming apparatus comprising:

a rotatable image bearing member that bears a toner image;

a transferring member that forms a transfer nip portion with the image bearing member; and a voltage application section that applies a voltage to the transferring member in such a manner that a certain amount of current flows through the transferring member, the method comprising:

setting a front-end current to a current that flows through the transferring member when a voltage having a polarity opposite to a transfer polarity and an absolute value substantially the same as or greater than an absolute value of a surface potential of the image bearing member is applied to the transferring member by the voltage application section based on a surface potential of the image bearing member;

comparing an applied voltage to flow a preset front-end current with respect to the transferring member and the surface potential of the image bearing member;

changing the front-end current in such a manner that the voltage is not substantially the same as or greater than the surface potential if the voltage is not substantially the same as or greater than the surface potential; and controlling the voltage application section in such a manner that the changed front-end current flows through the transferring member when a front-end portion of a recording sheet in a conveyance direction passes through the transfer nip portion, the front-end current being set to a current that flows through the transferring member when a voltage having a polarity opposite to a transfer polarity and an absolute value substantially the same as or greater than an absolute value of a surface potential of the image bearing member is applied to the transferring member by the voltage application section based on the surface potential of the image bearing member.

10. The method according to claim 9, wherein, in the controlling, the front-end current is set to a current that flows through the transferring member when a voltage having a polarity opposite to a transfer polarity and an absolute value equal to or greater than the absolute value of the surface potential is applied to the transferring member.

11. The method according to claim 9, wherein, in the controlling, the front-end current is set to a current that flows through the transferring member when a voltage having a polarity opposite to a transfer polarity is applied to the transferring member, and a ratio of the voltage to the surface potential is 0.9 or greater in absolute value.

12. The method according to claim 9, wherein, in the controlling, the voltage application section is controlled in such a manner that the front-end current flows through the transferring member during a period from a time when the front-end portion of the recording sheet in the conveyance direction starts to pass through the transfer nip portion until a time when the front-end portion of the recording sheet passes the transfer nip portion.

13. The method according to claim 9, wherein, in the controlling, the front-end current is set to a current that flows through the transferring member when a voltage having a polarity opposite to the transfer polarity and an absolute value substantially the same or greater than the absolute value of the surface potential is applied to the transferring member in a state where the recording sheet does not exist in the transfer nip portion.

14. The method according to claim 9, wherein the image forming apparatus further comprises a surface potential measuring section that measures a surface potential of the image bearing member, and in the controlling, a surface potential of the image bearing member is acquired on the basis of a measurement result of the surface potential measuring section.

15. The method according to claim 9, wherein the image forming apparatus further comprises a charging section that charges a surface of the image bearing member, and in the controlling, a surface potential of the image bearing member is estimated on the basis of a charging grid voltage applied to the charging section when the surface of the image bearing member is charged.

16. The method according to claim 9, wherein the image forming apparatus further comprises a charging section that charges a surface of the image bearing member, and in the controlling, a surface potential of the image bearing member is estimated on the basis of a charging current that flows from the charging section to the image bearing member when the surface of the image bearing member is charged.

* * * * *